United States Patent [19]

Taylor

[11] Patent Number: 4,964,175

[45] Date of Patent: Oct. 23, 1990

[54] HAIR PROTECTING DEVICE

[76] Inventor: Mary W. Taylor, 1605-1 Kent Dr., Wilson, N.C. 27893

[21] Appl. No.: 372,755

[22] Filed: Jun. 29, 1989

[51] Int. Cl.[5] ..... A41D 23/00

[52] U.S. Cl. ..... 2/171; 2/174; 2/DIG. 11; D2/253

[58] Field of Search ..... 2/15, 171, 171.4, 171.5, 2/171.6, 171.7, 171.8, 172, 174, 184.5, 197, 198, 207, 209.1, 209.3, 209.7, 410, 417, 418, 420, 423, DIG. 11; 128/380; D2/253, 509, 510, 512, 514, 515; D28/10, 39, 41

[56] References Cited

U.S. PATENT DOCUMENTS

| | | | |
|---|---|---|---|
| D. 277,330 | 1/1985 | Wasson | D2/253 |
| 1,633,586 | 6/1927 | Hunter . | |
| 1,652,933 | 12/1927 | Gaskell . | |
| 1,897,146 | 2/1933 | Richardson . | |
| 1,991,982 | 2/1935 | Hodges | 2/174 |
| 2,051,384 | 8/1936 | Lipton | D2/510 |
| 2,174,263 | 9/1939 | Guglielmi | 132/49 |
| 2,560,267 | 7/1951 | Baker et al. | 132/46 |
| 2,700,977 | 2/1955 | Neerup | 132/46 |
| 2,996,724 | 8/1961 | Rose et al. | 2/171 |
| 3,131,400 | 5/1964 | Blanchard | D2/510 |
| 3,357,027 | 12/1967 | Feil | 2/198 |
| 4,277,847 | 7/1981 | Florio | 2/12 |
| 4,394,782 | 7/1983 | Wasson | D2/253 |
| 4,698,852 | 10/1987 | Romero | 2/171 |
| 4,776,042 | 10/1988 | Hanson | 128/380 |

FOREIGN PATENT DOCUMENTS

| | | |
|---|---|---|
| 2390116 | 8/1978 | France . |
| 462984 | 4/1951 | Italy . |

OTHER PUBLICATIONS

Advertisement of The Company Store for a "Down Velcro Headband".

*Primary Examiner*—Werner H. Schroeder
*Assistant Examiner*—Diana L. Biefeld
*Attorney, Agent, or Firm*—Bell, Seltzer, Park & Gibson

[57] ABSTRACT

The fabric body of the device includes an inner satin-like fabric resistent to entanglement with hair engaged thereby, and an outer fabric which imparts strength, durability and cushioning to the device. Rear and side sections of the device respectively overlie the rear and sides of the head of a person wearing it. Strap-like sections extend from the side sections around the front, the opposite side, and part of the rear of the head of the user. Each strap-like section has a band of fastener material which releasably engages complementary fastener material upon the outer surface of the rear section of the device. A flap-like upper portion of the rear section of the device may be folded rearwardly and downwardly into overlying relationship with the fastener material and the outer ends of the strap-like sections. The upper and lower edges of the rear and side section of the body of the device are curved.

7 Claims, 1 Drawing Sheet

HAIR PROTECTING DEVICE

FIELD OF THE INVENTION

This invention relates to devices worn upon the head of a person for the purpose of preventing damage to his or her hair, particularly while the person is sleeping or at other times when a person's head is supported by a pillow or the like.

BACKGROUND OF THE INVENTION

The hair of many Afro-Americans, among other persons, tends to be tightly curled, coarse and somewhat brittle. Frequent chemical treatment is required for proper styling of such hair. In the absence of periodic treatment, the hair becomes more susceptible to breakage. Hair breakage is particularly likely to occur while a person occupies a reclined or prone position, as when sleeping, and his or her head is supported by a pillow, mattress, cushion or similar fabric covered article. The then-occurring breakage of hair, and particularly that upon the rear and/or sides of the person's head, is caused in part by the compressive force to which the hair is then subjected. However, the hair breakage is also in large part caused by entanglement of the hair with the fabric covering of the pillow and/or mattress upon which the person's head then rests. Entanglement and breakage of the hair is especially likely to occur when the fabric covering is relatively coarse and/or loosely woven, as is frequently the case.

The primary object of the present invention is the provision of an improved device for preventing hair damage of the aforesaid type. Related objects are the provision of a hair-protecting device which is of durable but economical construction, fits a wide range of head sizes, may be quickly and easily donned and doffed, is not uncomfortable to wear, and which possesses an attractive appearance.

DESCRIPTION OF THE PRIOR ART

Italian Patent No. 462984, French Patent No. 2,390,116, and the following U.S. Patents may be of interest relative to the present invention:

| U.S. Pat. No. | Date | Inventor |
|---|---|---|
| 1,633,586 | 6/28/27 | Hunter, W. A. |
| 1,652,933 | 12/13/27 | Gaskell, W. J. |
| 1,897,146 | 2/14/33 | Richardson, W. |
| 2,174,263 | 9/26/39 | Guglielmi, G. |
| 2,560,267 | 7/10/51 | Baker, B. R., et al. |
| 2,700,977 | 2/01/55 | Neerup, E. |
| 2,996,724 | 8/22/61 | Rose, L. E., et al. |
| 3,357,027 | 12/12/67 | Feil, M. M. |
| 4,277,847 | 7/14/81 | Florio, J. D. |
| 4,698,852 | 10/13/87 | Romero, L. A. |

SUMMARY OF THE INVENTION

The present invention provides an improved hair protecting device realizing the above-mentioned objects.

In a preferred embodiment thereof, the device of the invention includes an elongate flexible fabric body having rear and side sections bordered by curved upper and lower edges. The body also has strap-like sections connected to respective ones of the side sections. The rear and side sections of the body have smooth inner surfaces that respectively overlie the rear sides of the head of a person wearing the device. Fastener material, preferably of the hook/loop type sold trademark VELCRO®, is secured upon the outer surface of the rear section of the body. The fastener material is spaced sufficiently below the upper edge of the body as to the flap-like fabric portion above the fastener material to be folded rearwardly and downwardly into overlying relationship with the material. Bands of mating fastener material are secured to the free end portions of the strap sections of the body. During use of the device, each of the strap sections extends from the thereto connected side section of the about the front and one of the sides of the head of the of the device, and the band of fastener material thereon engages the mating fastener material upon the outer surface of the rear section of the body.

Preferably the body is formed of an inner ply of satin-like fabric that contacts and is resistent to entanglement with hair engaged and an outer ply of a different fabric which enhances the strength and durability of the device and may also perform a "cushioning" function. The upper edge of the rear and sections of the device may be and preferably is of a regular convex curvature, while the lower edge of such sections is of a sinuous nature having a convex central portion with concave end portions.

BRIEF DESCRIPTION OF THE DRAWINGS

Other features of the will be apparent from the following description of an illustrative embodiment thereof, which should be read in conjunction with the accompanying drawing in which.

DESCRIPTION OF THE PREFERRED EMBODIMENT

Figure 2:
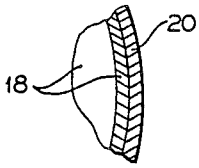
FIG. 2 is a fragmentary sectional view taken substantially along the line 2—2 of the device of FIG. 1.

Referring more particularly to the drawing, the device identified in its entirety by numeral 10 consists of an elongate fabric body having a section 12, tapered side sections 14, 14', and strap 16, 16', The aforesaid sections of device 10 are preferably and illustratively integrally connected, and are from two superimposed plys of fabric 18, 20 (FIG. 2 inner ply fabric 18 preferably is of a smooth material that is resistent to entanglement withhair engaged thereby. The outer ply fabric 22 preferably and illustratively is of a different material that imparts additional strength and/or durability to device 10, performs a "cushioning" function, and has an attractive appearance.

Figure 1:
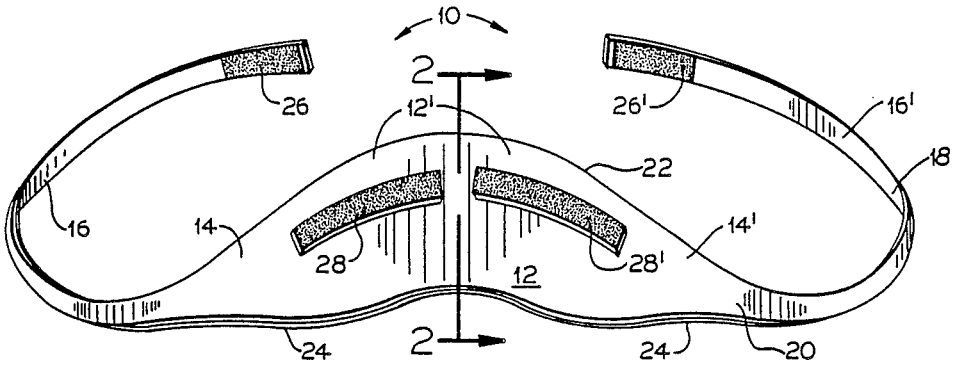
FIG. 1 is a rear elevational view of a hair protecting device in accordance with the invention.

As is best shown in FIG. 1, rear section 12 and side sections 14, 14, of device 10 are bordered by an arcuate upper edge 22 of regular convex curvature, and by a sinuous complexly curved lower edge 24 having a convex central portion merging at its opposite ends concave side portions. As is indicated in FIG. 2 of the drawings, rear section 12 is of vertically and horizontally cup-like configuration, which allows it to conform readily and neatly to the rear part of the head of the person device 10.

A pair of aligned elongate bands 26, 26' of fastener material, which is preferably and illustratively of the hook/loop type sold under trademark VELCRO ®, are permanently secured in any manner to the outer surface of rear section 12 of device 10. Bands 28, 28' extend generally parallel to upper 22 of central section 12, and are spaced sufficiently below edge as to be covered by a flap-like upper portion 12' rear section 12 when such flap is folded rearwardly and downwardly into overlying relationship with bands 28, 28'. Bands 26, 26' of mating loop/hook fastener material are suitably secured upon the inner surfaces of the free end of strap sections 16, 16' of device 10. Bands 26, 26' need not be, and preferably are not, as long as bands 28, 28'.

Figure 3:
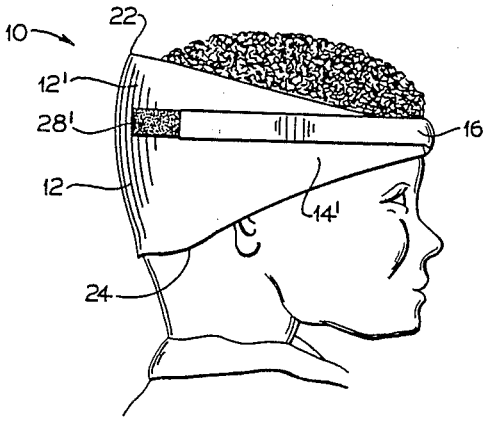
FIG. 3 is a side view of the device in place upon the head of the user.
Figure 4:
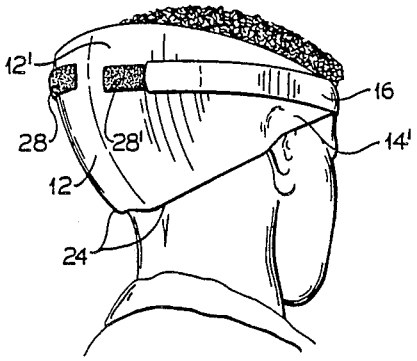
FIG. 4 is a view similar FIG. 3 from a more rearward viewpoint.
Figure 5:
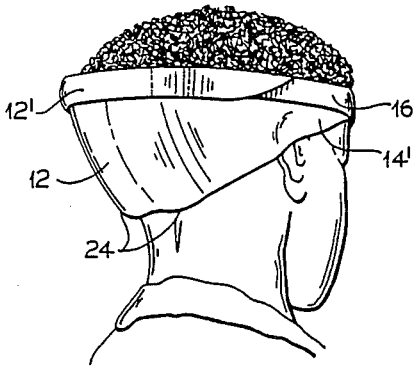
FIG. 5 is a elevational view similar to FIG. 4, but wherein a flap-like upper edge portion of the rear part of the device is disposed in an alternative, downwardly-folded position.

When in place upon the head of a person, as shown in FIGS. 3-5 of the drawings, the rear section 12 of device 10 overlies and engages the rear of the head of the wearer, and side sections 14, 14' overlie respective sides of the wearer's head. Each strap section 16, 16, extends around the forehead of the wearer, along side of the wearer's head distal from the side section 14, 14' to which such strap is connected, and part way about rear of the head of the wearer. The fastener material 26, 26' adjacent the outer ends of strap sections 16 16' respectively grippingly engage the adjacent bands 28, 28' of mating fastener material upon rear section 12 of the device, which secures the device in place. The considerable length of bands 28, 28' permits adjustment of the circumferential dimension of device 10 so that it will fit snugly but comfortably heads of significantly differing sizes.

It will be apparent that device 10 prevents the hair upon the rear and sides of the head of a person wearing it from engaging and possibly becoming entangled with the frequently relatively coarse fabric upon a bed, sofa, pillow or similar head-supporting used by a person. In addition to thus preventing entanglement-induced hair breakage, device 10 also tends to cushion and thus alleviate compressive forces tending to cause hair damage by a "crushing" action.

When device 10 is being worn during sleeping, flap-like upper edge portion 12' of central section 12 preferably is allowed to extend upwardly so as to discourage or minimize engagement between the bed linen and any hair that might then extend from the adjacent rear of the open top of device 10. However, when such is not needed, as would be the case when the person wearing device 10 is moving about or is seated in other than a high-back chair, flap-like portion 12' of section 12 be folded downwardly and rearwardly into overlying with bands 26, 26', 28, 28, and the free end portions of straps 16, 16'. Device 10 then possesses the neat and attractive configuration indicated in FIG. 5, wherein its upper edge extends generally horizontally and the fastener bands and strap ends are concealed from view.

The convex shape of the center portion of lower edge 24 of device 10 permits the device to be more comfortably worn by persons having rolls of upon their necks as is not uncommon.

Device 10 performs primary, hair-protecting function whenever it is worn. If worn immediately after chemical treatment of a person, hair, it also protects the person's clothing, bed linens the like from exposure to the treatment chemicals.

While a preferred embodiment of the invention has been specifically shown and described, this was for purposes of illustration only and not for purposes of limitation, the scope of the invention being in accordance with the following claims.

That Which is Claimed

1. A hair-protecting adapted to be worn upon the head of a person, comprising:

an elongate flex fabric body including a generally cup-shaped rear section, first and second side sections connected to and extending from opposite sides of said rear section, and first and second strap-like sections connected to and extending from respective ones of said side sections;

said body having upon at least said rear and side sections thereof an inner-ply fabric of smooth satin-like construction resistent to entanglement with hair engaged thereby;

each of said strap-like sections of said body having a flexible band of fastener material of the hook/loop type secured thereto adjacent the free end thereof;

complementary fastener material of the loop/hook type upon the outer surface of said rear section of said body, said rear and side sections of said body having an upper edge and said complementary fastener material being spaced sufficiently below said upper edge as to permit a flap-like portion of said body which normally projects above said complementary fastener material to be folded rearwardly and downwardly over said complementary fastener material;

said rear section of said body being adapted to overlie the rear of the head of the person wearing said device, and said side sections of said device being adapted to overlie respective opposite sides of the head of said person;

each of said strap-like sections extending during use of said device from the thereto connected one of said side sections about the front, a side and part of the rear of the head of said person, and said band of fastener material thereon being in engaged relationship with said complementary fastener material upon said outer surface of said rear section of said body.

2. A device as in claim 1, wherein said body includes an outer-ply fabric overlying said inner-ply fabric, said outer-ply fabric being of a construction different from said inner-ply fabric and imparting additional strength and cushioning to said body.

3. A device as in claim 1, wherein said complementary fastener material includes first and second elongate bands of said complementary fastener material, said bands extending generally parallel to said upper edge of said rear section of said body.

4. A device as in claim 3, wherein said bands of said complementary fastener material are in spaced, generally aligned relationship to each other, and are longer than said bands upon said strap-like sections.

5. A device as in claim 1, wherein said upper edge of said rear and side sections of said body is of convex curvature, and said sections have a lower edge of a sinuous complexly curved shape.

6. A device as in claim 5, wherein said lower edge has a convex central portion concave side portions.

7. A device as in claim 1, wherein said flap-like portion, when folded downward and rearwardly during use of said device, conceals from view said fastener material and the free end portion of said strap-like sections of said body.

* * * * *

UNITED STATES PATENT AND TRADEMARK OFFICE

CERTIFICATE OF CORRECTION

PATENT NO. : 4,964,175

DATED : October 23, 1990

INVENTOR(S) : Mary W. Taylor

It is certified that error appears in the above-identified patent and that said Letters Patent is hereby corrected as shown below:

Col. 1, Line 67, "and" should be between rear and sides

Col. 2, Line 1, "under the" should be before trademark

Col. 2, Line 4, "permit" should be before the

Col. 2, Line 11, "body" should be before about

Col. 2, Line 12, "user" should be before of the device

Col. 2, Line 13, "releasably" should be before engages

Col. 2, Line 17, "thereby" after engaged; "," should be after engaged

Col. 2, Line 21, "side" should be before sections

Col. 2, Line 22, "preferably" comes after sections

Col. 2, Line 23, "that merges" should be after portion

Col. 2, Line 28, "invention" should be after of the

Col. 2, Line 38, (Fig. 4), "to" should be after similar

Col. 2, Line 48, "The" should be after by

Col. 2, Line 49, "rear" should be before section

Col. 2, Line 51, "sections" should be after strap

Col. 2, Line 51, "," should be a .

Col. 2, Line 52, "formed" should be before from

Col. 2, Line 53, "))." should be after Fig. 2

Col. 2, Line 53, "The" should be before inner

Col. 2, Line 54, "satin-like" should be before material like

Col. 2, Line 56, a space should be between with and hair

Col. 2, Line 61, 14', should be after 14 instead of 14,14

UNITED STATES PATENT AND TRADEMARK OFFICE

CERTIFICATE OF CORRECTION

PATENT NO. : 4,964,175

DATED : October 23, 1990

INVENTOR(S) : Mary W. Taylor

It is certified that error appears in the above-identified patent and that said Letters Patent is hereby corrected as shown below:

Col. 2, Line 65, "with" should be before concave

Col. 2, Line 68, "curved"should be before cup-like

Col. 3, Line 2, "wearing" should be before device

Col. 3, Line 5, "the" should be before trademark

Col. 3, Line 6, "suitable" should be before manner

Col. 3, Line 8, "edge" should be after upper

Col. 3, Line 9, "such" should be before edge

Col. 3, Line 10, "of" should be before rear

Col. 3, Line 14, "portions" should be after end

Col. 3, Line 19, "part" should be after rear

Col. 3, Line 21, "16" "should be the second reading of "16"

Col. 3, Line 22, "that" should be after long

Col. 3, Line 24, "the" should be before rear

Col. 3, Line 25, "bands" should be after material

Col. 3, LIne 38, "article" should be after supporting

Col. 3, Line 46, "linen" should be plural

Col. 3, Line 47, "portion" should be after rear

Col. 3, Line 48, "protection" should be after such

Col. 3, LIne 51, "may" should be before be

Col. 3, Line 52, "relationship" should be after overlying

Col. 3, Line 53, "28'" should be the second reading of "28"

Col. 3, Line 60, "flesh" should be before upon

UNITED STATES PATENT AND TRADEMARK OFFICE

CERTIFICATE OF CORRECTION

PATENT NO. : 4,964,175

DATED : October 23, 1990

INVENTOR(S) : Mary W. Taylor

It is certified that error appears in the above-identified patent and that said Letters Patent is hereby corrected as shown below:

Col. 3, Line 63, "its" should be before primary

Col. 3, Line 64, "person," should be person's

Col. 3, Line 65, "and" 1st. occurance should be before the

Col. 4, Line 5, "device" should be after hair-protecting

Col. 4, LIne 7, "flex" should be flexible

Col. 4, Line 62, "and"should be placed between portion and concave

Col. 4, Line 64, "downard" should be downwardly

Signed and Sealed this

Twenty-sixth Day of May, 1992

*Attest:*

DOUGLAS B. COMER

*Attesting Officer*

*Acting Commissioner of Patents and Trademarks*